United States Patent [19]

Fourneaux

[11] Patent Number: 5,018,557

[45] Date of Patent: May 28, 1991

[54] WEFT-SWITCHING SYSTEM WITH TELESCOPING NOZZLES

[75] Inventor: Roger Fourneaux, La Tour du Pin, France

[73] Assignee: S. A. Saurer Diederichs (Societe Anonyme), Bourgoin Jallieu, France

[21] Appl. No.: 495,022

[22] Filed: Mar. 16, 1990

[30] Foreign Application Priority Data

Mar. 22, 1989 [FR] France ..... 89 04032

[51] Int. Cl.[5] ..... D03D 47/30

[52] U.S. Cl. ..... 139/450; 139/435.1; 139/452

[58] Field of Search ..... 139/450, 452, 453, 435.1

[56] References Cited

U.S. PATENT DOCUMENTS

| | | | |
|---|---|---|---|
| 3,342,220 | 9/1967 | Bartosels et al. | 139/453 |
| 4,756,341 | 7/1988 | Takehana | 139/453.1 |
| 4,856,691 | 8/1989 | Takehana et al. | 139/450 X |

*Primary Examiner*—Andrew M. Falik

*Attorney, Agent, or Firm*—Herbert Dubno; Andrew Wilford

[57] ABSTRACT

A shuttleless loom has an injection nozzle that is movable limitedly in the warp direction to one side of the warp and that has a filament-receiving upstream end and a filament-ejecting downstream end from which a weft filament is project in the weft direction through the warp. Separate generally stationary first and second yarn supplies to one side of the warp are associated with respective telescoping feed nozzles to the one side of the warp and each having a generally stationary upstream end and a downstream end displaceable between an advanced position relatively close to the injection nozzle and a retracted position relatively far from the injection nozzle. Respective actuators can displace the first and second nozzles between their positions and respective first and second feeders between the nozzles and the respective supplies supply filaments from the respective supplies to the upstream ends of the respective nozzles so that the respective filaments are ejected from the respective downstream ends thereof. A controller connected to the actuators switches the loom from the filament of one of the supplies to the filament of the other supply by displacing the downstream end of the telescoping nozzle of the other supply to the advanced position and then pneumatically blowing the respective filament from the downstream end of the nozzle of the other supply into the upstream end of the injection nozzle.

8 Claims, 1 Drawing Sheet

WEFT-SWITCHING SYSTEM WITH TELESCOPING NOZZLES

FIELD OF THE INVENTION

The present invention relates to a shuttleless loom. More particularly this invention concerns a multiple yarn-feeding and switching system for such a loom.

BACKGROUND OF THE INVENTION

In a standard shuttleless loom a weft yarn is pulled from a supply spool by a mechanical feeder and is fed thereby to an injection nozzle that is directed crosswise through a shed formed between upper and lower groups of warp yarns. Inside the shed the yarn is guided along a passage formed by the teeth of a confining comb mounted on a sley along with the beating comb or reed. The yarn is moved the entire weft-wise width of the fabric by relay nozzles spaced along the shed and pressurized sequentially. At the downstream edge of the goods the yarn is trapped by a weft-yarn aspirator and held thereby.

It is standard to provide a pair of such supplies and feeders. This allows weaving to continue with a yarn from a second supply when the first supply runs out or jams, and also serves for color change if desired. As described in European patent application 195,469 filed by J. Waelkens based on a Belgian priority of 24 Sept. 1985 two separate weft-filament feeders are provided adjacent a common injection nozzle, the latter being carried on the beating-in comb for warpwise movement therewith. There is no disclosure of how the new yarn is threaded into the injection nozzle on switchover.

European patent application 291,486 filed by J. Tacq based on a Belgian priority of 17 Nov. 1988 has a similar pair of feeders and a single injection nozzle. Here, however, each of the feeders, which each comprise a yarn package and payout device having a feed nozzle, has an output aligned at an acute angle with the intake of the injection nozzle. To make it possible to thread a new filament into the injection nozzle despite the turbulence of the various air currents created in such a pneumatic delivery system, each of the feeders can be moved to a position very close to the upstream end of the injection nozzle for feeding thereto a new filament. Such a system is fairly complex and involves moving around a substantial amount of delicate equipment at each filament change.

OBJECTS OF THE INVENTION

It is therefore an object of the present invention to provide an improved system for feeding weft filaments to a shuttleless loom.

Another object is the provision of such an improved system for feeding weft filaments to a shuttleless loom which overcomes the above-given disadvantages, that is which ensures accurate and sure switchover from one supply to the other, but which is of relatively simple and foolproof construction.

SUMMARY OF THE INVENTION

A shuttleless loom in which a weft filament is inserted crosswise in a weft direction into a warp moving in a warp direction transverse to the weft direction has an injection nozzle that is movable limitedly in the warp direction to one side of the warp and that has a filament-receiving upstream end and a filament-ejecting downstream end from which a weft filament is projected in the weft direction through the warp. Separate generally stationary first and second yarn supplies to one side of the warp are associated with respective telescoping feed nozzles to the one side of the warp and each having a generally stationary upstream end and a downstream end displaceable between an advanced position relatively close to the injection nozzle and a retracted position relatively far from the injection nozzle Respective actuators can displace the first and second nozzles between their positions and respective first and second feeders between the nozzles and the respective supplies supply filaments from the respective supplies to the upstream ends of the respective nozzles so that the respective filaments are ejected from the respective downstream ends thereof. A controller connected to the actuators switches the loom from the filament of one of the supplies to the filament of the other supply by displacing the downstream end of the telescoping nozzle of the other supply to the advanced position and then pneumatically blowing the respective filament from the downstream end of the nozzle of the other supply into the upstream end of the injection nozzle.

With this system therefore as a filament change is initiated the feed nozzle of the supply from which the new filament is to come is extended to virtually fit with the upstream end of the injection nozzle which to this end is held in a predetermined starting position.

According to another feature of this invention each of the feed nozzles comprises a fixed inner tube and an outer tube coaxial to the respective inner tube and displaceable thereon between the positions. Each actuator comprises an accordion-pleated cuff having one end fixed on the outer tube and an opposite end fixed relative to the inner tube and defining a pressurizable chamber so that pressurization of the chamber extends the respective cuff and moves the respective outer tube into the respective advanced position.

Furthermore in accordance with this invention each actuator can comprise a double-acting fluid-powered cylinder fixed between the ends of the respective nozzle. The injection nozzle is provided at its upstream end with a formation adapted to catch and receive a filament projected from the downstream end of a one of the feed nozzles. Furthermore the actuators can be fluid-powered and the controller includes respective first and second valves controlling fluid feed to the actuators. Each of the nozzles can also be formed of three or more telescoping parts.

DESCRIPTION OF THE DRAWING

The above and other objects, features, and advantages will become more readily apparent from the following, reference being made to the accompanying drawing in which.

SPECIFIC DESCRIPTION

Figure 1:
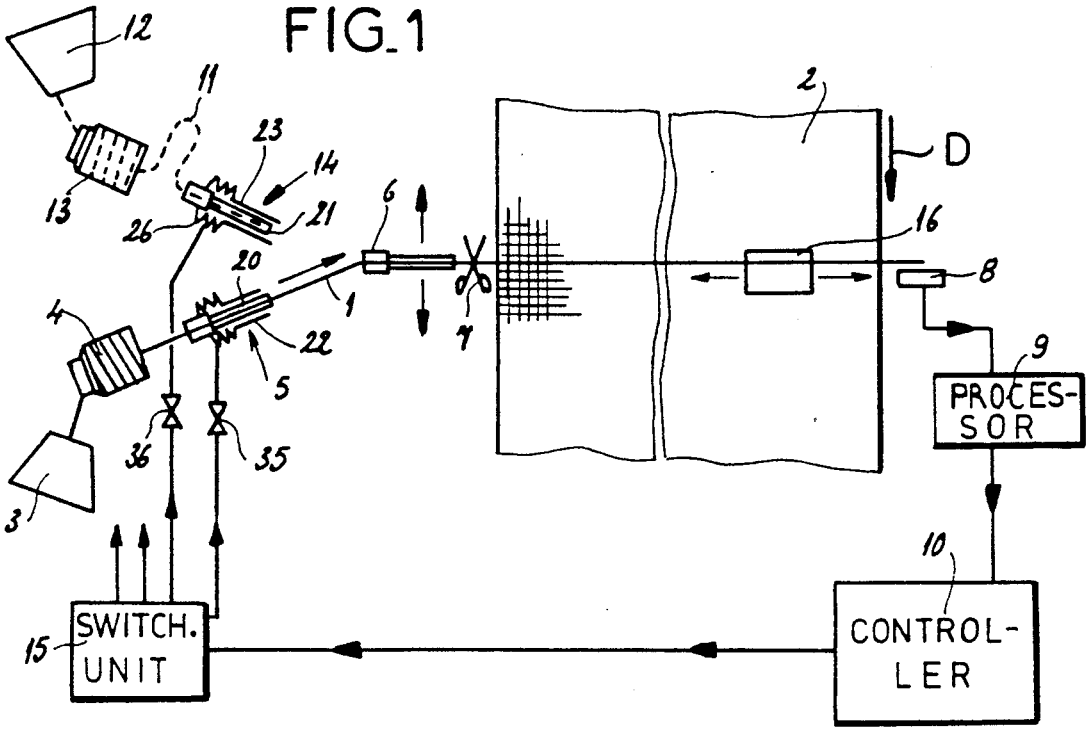
FIG. 1 is a largely schematic top view of a shuttleless loom according to this invention.

As seen in FIG. 1 a pneumatic-feed shuttleless loom according to this invention incorporates picks of a first weft yarn or filament 1 into a shed of a warp 2 that itself normally moves in a direction D perpendicular to the weft 1. This weft filament 1 is drawn from a bobbin or yarn package 3 and fed through a paying-out unit 4 that is synchronized with the loom to deliver premeasured lengths of the filament 1 to an injector nozzle 6 that moves with the unillustrated sley of the loom as its comb of reed beats in the filament 1. The nozzles 5 and 6 are both of the pneumatic type that convey the filament on a jet of high-pressure air, and further unillustrated relay nozzles are provided along the warp 2 for moving the weft pick through the warp 2.

At the downstream side of the warp 2 there is a weft-filament detector 8 that is connected via a signal processor 9 to the main controller 10 of the loom, which controller 10 can be an electronic microprocessor. An apparatus 16 of the type described in copending patent application 07/357,560 filed 25 May 1989 is used to remove broken weft filaments.

A second weft filament 11 is pulled from a supply 12 through a paying-out unit 13 and is fed to a second feed nozzle 14. The elements 12, 13, and 14 are identical to the corresponding elements 3, 4, and 5. The nozzles 5 and 14 are centered on respective axes 17 and 18 that form identical acute angles A with an axis 19 of the injection nozzle 6, the latter axis 19 being perpendicular to the direction D. A cutting device shown schematically at 7 is provided for cutting the filaments 1 and 11 after each insertion.

The detector 8, processor 9, and controller 10 function according to copending patent application 07/477,359 filed 07 Feb. 1990 to operate a switching unit 15 for switching between the filaments 1 and 11 when, for instance, one of the supplies runs out.

Figure 2:
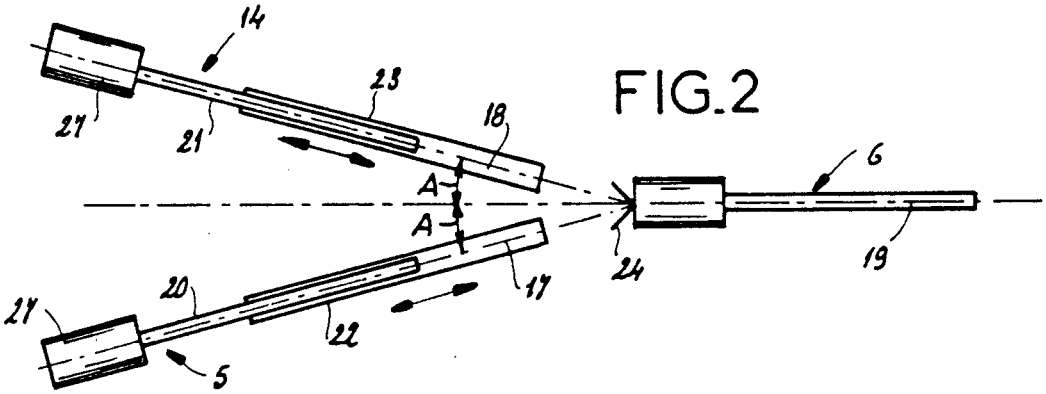
FIG. 2 is a larger-scale detail of FIG. 1.
Figure 3:
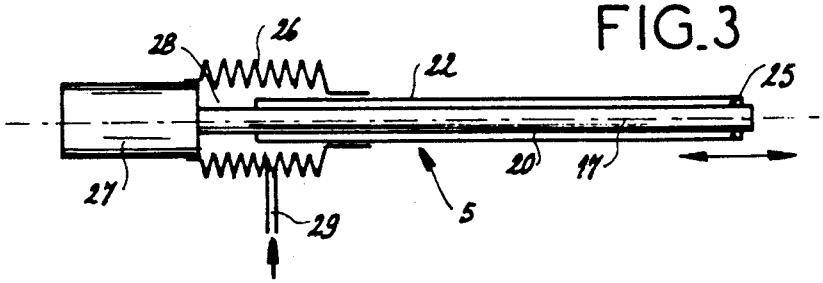
FIG. 3 is a large-scale detail of FIG. 2.

In accordance with the instant invention as shown in better detail in FIG. 2 the identical nozzles 5 and 14 are each formed by respective inner tubes 20 and 21 that telescope with respective outer tubes 22 and 23. More specifically as seen in FIG. 3 the inner tube 20 is mounted at its rear end on a stationary support 27 and is sealed at its front end by a slide seal 25 with the outer tube 22. In addition a bellows 26 has a rear end connected to the support 27 and a front end to the rear portion of the tube 22 so as to define an annular pressurizable chamber 28 around the tubes 20 and 22. Air fed under pressure at 29 to the chamber 28 therefore axially expands the bellows 26 which, like an actuator, telescopes the outer tube 22 forward until its outer or downstream end lies very close to the inlet cone 24 of the injection nozzle 6 in the stationary starting position thereof. When depressurized, the cuff 26 acts like a tension spring to pull the outer tube 22 back to the retracted position. The switching unit 15 has electrical valves 35 and 36 connected to the respective actuators 26 to extend the respective nozzles 5 and 14 as necessary to feed a new filament 1 or 11 to the nozzle 6.

Figure 4:
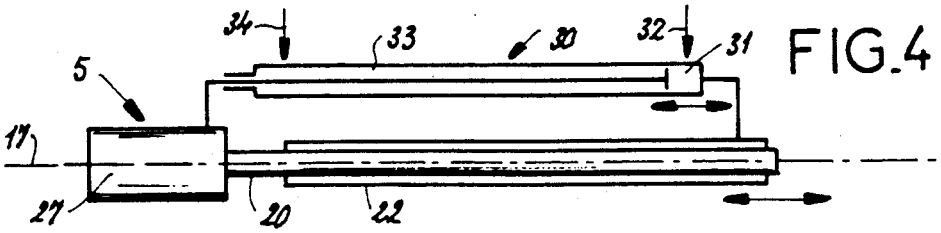
FIG. 4 is a view like FIG. 3 of a variant on the system of this invention.

Alternately it is possible to provide a double-acting pneumatic actuator 30 as seen in FIG. 4 between the inner and outer tubes 20 and 22. A front chamber 31 of this actuator 30 is pressurized at 32 to extend or advance the tube 22 and a back chamber 33 is pressurized at 34 to retract it.

Thus with the system of this invention it is possible to physically extend by telescoping either of the nozzles 5 or 14 right up to the inlet of the nozzle 6 when the filament is to be changed. If the distance is long more than two telescoping parts can be used, or any other type of actuator, for instance a rack arrangement, could be used for such telescoping action.

I claim:

1. A shuttleless loom wherein a weft filament is inserted crosswise in a weft direction into a warp moving in a warp direction transverse to the weft direction, the loom comprising:

means including an injection nozzle that is movable limitedly in the warp direction to one side of the warp and that has a filament-receiving upstream end and a filament-ejecting downstream end from which a weft filament is projected in the weft direction through the warp;

separate generally stationary first and second yarn supplies to one side of the warp;

respective first and second telescoping feed nozzles to the one side of the warp and each having a generally stationary upstream end and a downstream end displaceable between an advanced position relatively close to the injection nozzle and a retracted position relatively far from the injection nozzle;

respective actuators for displacing the first and second nozzles between their positions;

respective first and second feed means between the nozzles and the respective supplies for feeding filaments from the respective supplies to the upstream ends of the respective nozzles so that the respective filaments are ejected from the respective downstream ends thereof; and control means connected to the actuators for switching from the filament of one of the supplies to the filament of the other supply by displacing the downstream end of the telescoping nozzle of the other supply to the advanced position and then pneumatically blowing the respective filament from the downstream end of the nozzle of the other supply into the upstream end of the injection nozzle.

2. The shuttleless loom defined in claim 1 wherein each of the feed nozzles comprises a fixed inner tube, and an outer tube coaxial to the respective inner tube and displaceable thereon between the positions.

3. The shuttleless loom defined in claim 2 wherein each actuator comprises an accordion-pleated cuff having one end fixed on the outer tube and an opposite end fixed relative to the inner tube and defining a pressurizable chamber, whereby pressurization of the chamber extends the respective cuff and moves the respective outer tube into the respective advanced position.

4. The shuttleless loom defined in claim 2 further comprising a seal ring between the tubes.

5. The shuttleless loom defined in claim 1 wherein each actuator comprises a double-acting fluid-powered cylinder fixed between the ends of the respective nozzle.

6. The shuttleless loom defined in claim 1 wherein the injection nozzle is provided at its upstream end with a formation adapted to catch and receive a filament projected from the downstream end of a one of the feed nozzles.

7. The shuttleless loom defined in claim 1 wherein the actuators are fluid-powered and the control means includes respective first and second valve means controlling fluid feed to the actuators.

8. The shuttleless loom defined in claim 1 wherein each of the nozzles is formed of a plurality of telescoping parts

* * * * *